United States Patent [19]

Frenzel et al.

[11] Patent Number: 4,873,844

[45] Date of Patent: Oct. 17, 1989

[54] METHOD AND APPARATUS FOR THE PRODUCTION OF TEXTILE STRIP

[75] Inventors: Bertram Frenzel; Dietmar Grenzendorfer; Heinz Kemter; Wolfgang Wünsch; Peter Zeisberg, all of Karl-Marx-Stadt, German Democratic Rep.

[73] Assignee: VEB Kombinat Textima, Karl-Marx-Stadt, German Democratic Rep.

[21] Appl. No.: 14,152

[22] Filed: Feb. 12, 1987

Related U.S. Application Data

[63] Continuation of Ser. No. 559,116, Dec. 7, 1983, abandoned.

[30] Foreign Application Priority Data

Feb. 28, 1983 [DD] German Democratic Rep. ..... 2483026

[51] Int. Cl.[4] ..... D04B 23/06

[52] U.S. Cl. ..... 66/84 A; 28/100; 66/85 A

[58] Field of Search ..... 66/84 A, 85 A, 190–195, 66/203; 28/100, 101

[56] References Cited

U.S. PATENT DOCUMENTS

| | | | |
|---|---|---|---|
| 2,890,579 | 6/1959 | Mauersberger | 66/192 |
| 3,321,348 | 5/1967 | Rupp | 66/84 A |
| 3,422,511 | 1/1969 | Seguin | 28/101 |
| 3,573,151 | 3/1971 | Dawbarn | 156/439 |
| 3,680,332 | 8/1972 | Bassist | 66/84 A |
| 3,756,893 | 9/1973 | Smith | 156/440 |
| 3,878,591 | 4/1975 | Jense | 28/100 |
| 3,950,583 | 4/1976 | Patin | 28/101 |
| 4,395,888 | 8/1983 | Wilkens | 66/84 A |
| 4,484,459 | 11/1984 | Hutson | 66/84 A |
| 4,567,738 | 2/1986 | Hutson et al. | 66/85 A |

FOREIGN PATENT DOCUMENTS

| | | | |
|---|---|---|---|
| 45-33874 | 10/1970 | Japan | 66/85 A |

OTHER PUBLICATIONS

Bahlo, American Association for Textile Technology, "New Fabrics without Wearing", 11-1965.

Sewing-Knitting Machines, Malimo Technical Possibilities & Technology.

*Primary Examiner*—Ronald Feldbaum

*Attorney, Agent, or Firm*—Jordan and Hamburg

[57] ABSTRACT

A method and apparatus for the production of a textile strip, by preparing and aftertreating an intermediate product, with the product textile strip being a new article of manufacture and having long weft elements, especially long weft threads, provided diagonally to the strip length, intersecting one another, and connected by longitudinal rows of stitches. The apparatus includes a device on a warp knitting machine, particularly a thread knitting machine, having at least one movable weft laying device, in order to work long weft elements or weft threads, which extend over the entire working width, into the textile strip. A strip of a weft and warp knit is initially produced as intermediate product, having long weft elements, particularly long weft threads, connected by stitches, by subsequently bringing the weft threads into a very oblique position relative to the strip length, by diagonal displacement of the strip of the weft and warp knit, by doubling the weft and warp knit, so that the oblique long welf threads of one main layer of the doubled material intersect the oblique long weft threads of the other main layer, and by finally fastening the two main layers of the doubled welf and warp knit with a top binding consisting of a number of rows of stitches running along the weft and warp knit.

20 Claims, 6 Drawing Sheets

METHOD AND APPARATUS FOR THE PRODUCTION OF TEXTILE STRIP

This application is a continuation of application Ser. No. 559,116, filed Dec. 7, 1983, now abandoned.

BACKGROUND OF THE INVENTION AND PRIOR ART STATEMENT

The invention relates to a method and apparatus for the production of a textile strip, by preparing and after-treating an intermediate product, with the product textile strip being a new article of manufacture and having long weft elements, especially long weft threads, provided diagonally to the strip length, intersecting one another, and connected by longitudinal rows of stitches.

Furthermore, the invention relates to a product textile strip as an article of manufacture and, produced according to the method of the invention, as well as to a device on a warp knitting machine, particularly a stitch knitting machine, having at least one movable weft laying device, for working long weft elements or weft threads, which extend over the entire working width, into the textile strip.

To connect weft elements with stitch forming warp threads, a warp knitting machine uses a conventional needle system.

A method is known for the production of thread knitted textile strips with diagonally running long weft threads on a warp knitting machine, as well as thread knitting machines which, when being used, make it necessary to design the operative width of the weft laying device, so that the distance from the first to the last thread of the weft thread group to be placed corresponds to a one to three and a half time expansion of the working width of the machine (Jap. patent application 42-67693).

If zig-zag like long weft threads are to intersect at an angle of 90°, or if the angle between the weft threads and a fictitious straight line, extending at right angles to the edge of the first fabric, is to be 45°, the operative width of the weft laying device (which corresponds to the width of the long weft thread group to be placed) is twice as long as the working width of the machine. If the angle, formed by the long weft threads with the fictitious straight line is 60°, then the operative width of the weft laying device has to be approximately three and a half times the working width. At a working width of 3.5 m, which is the customary width for thread knitting machines, the weft laying device would have to be more than 10 m wide, and correspondingly massive.

Such a weft laying device results in a relatively slow mode of operation, which in most cases is not economically justifiable.

The described method is accomplished by a weft laying device, which moves back and forth at right angles in relation to the length of the textile strip. The placed group of long weft threads is guided by two weft thread transport means, into which the long weft threads are hung in the direction of a stitch formation zone, at which point the weft threads join the warp threads, forming a textile strip.

SUMMARY OF THE INVENTION

It is an object of the invention to provide additional methods for the production of symmetrical textile strips, which will additionally result in larger economical savings.

It is the object of another invention to produce a method and apparatus for the production of a textile strip with essentially diagonally running long weft elements, especially long weft threads, making it possible to keep the heretofore used means for the laying of the weft threads over the entire width, maintaining them in their structural magnitudes and mechanical positions, and making them suitable for the intended purpose. These and other objects and advantages of the present invention will become evident from the description which follows.

The objects of the invention are accomplished by this method by initially producing a strip of a weft and warp knit as intermediate product, having long weft elements, particularly long weft threads, connected by stitches, by subsequently bringing the long weft threads into a very oblique position relative to the strip length, by diagonal displacement of the strip of the weft and warp knit, by doubling the weft and warp knit into two main layers so that the oblique long weft threads of one main layer of the doubled material intersect the oblique long weft threads of the other main layer, and by finally fastening the two main layers of the doubled weft and warp knit with a top binding consisting of a number of rows of stitches running along the weft and warp knit.

A preferred embodiment of the textile strip, produced according to the method of the invention, consists of two main layers, each consisting of a basic binding with long weft threads connected to the basic binding, with each basic binding having stitch loops on one side and connection stitches on the other side, with the main layers being connected to one another with a basic binding having shorter stitch loops, as well as with a smaller number of needles than is the case with other basic bindings of the main layers.

By means of a warp knitting machine, especially a thread knitting machine for the production of an intermediate product for the textile strip, produced according to the aforementioned method, with the weft laying device being diagonally movable back and forth between two transport chains, an intermediate product can represent the basis for the production of a textile strip, with its long weft threads having a very oblique position from the very beginning without having been diagonally displaced. If this initially very oblique position of the long weft threads is not oblique enough, an increasingly oblique position is achieved by minimal diagonal displacement.

The invention makes it possible to produce a textile strip, in which the oblique long weft threads of one main layer diagonally intersect the oblique long weft threads of the other main layer, without the magnitudes of the weft laying device, common in warp knitting machines, having to be replaced by means which would have to have oversized dimensions.

Because of the invention, the production of textile strips can be made much more cost efficient. The invention accordingly consists in the method and apparatus for the production of the textile strip, and the textile strip per se as an article of manufacture, as described supra, and as will appear infra from the description of the drawings and preferred embodiments, and as elucidated in the appended claims.

BRIEF DESCRIPTION OF THE DRAWINGS

FIG. 11 is a perspective view similar to FIG. 10, but with three weft laying devices; and FIG. 12 is a perspective view similar to FIG. 11 but the three weft laying devices being different.

DETAILED DESCRIPTION OF THE PREFERRED EMBODIMENTS

Figure 1:
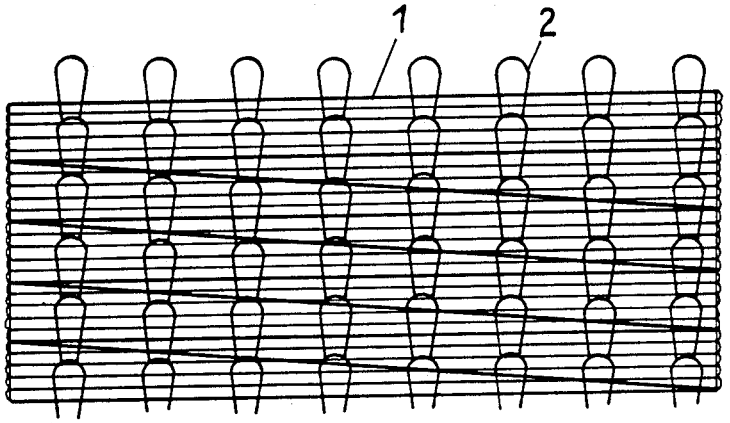
FIG. 1 shows a thread knitted weft and warp knit as intermediate product, with the long weft threads being arranged in a slightly oblique fashion.

FIG. 1 shows a weft and warp knit as intermediate product, constructed as thread knitted material. This thread knitted material consists of grouped zig-zag weft threads 1, which extend from one thread knitted fabric edge to the other in the form of long weft threads 1, and of a binding system 2, with which the long weft threads 1 are combined with a weft and warp knit. The long weft threads 1 are arranged in a slightly oblique fashion, and the binding system 2 can consist of any basic binding of warp knitted fabrics. Likewise, combinations of basic bindings can be used to combine the long weft threads 1. A weft and warp knit is furthermore suited as intermediate product for continued processing, with the long weft threads being provided at a right angle to the knitted edges. The base material of the weft and warp knit can also consist of long weft elements 1, such as, for example, foil bands. The threads of the binding system 2 are made from materials which are as smooth and thin as possible, and the long weft threads 1 should be easily displaceable in the binding system 2.

The stitches of the binding system 2 are preferably formed rather long and loose, and the distance from a perpendicular row of stitches to a neighboring row of stitches preferably corresponds to a large number of needles.

The production of the weft and warp knit as intermediate product represents the first process step of the production of a textile strip according to the invention.

Figure 2:
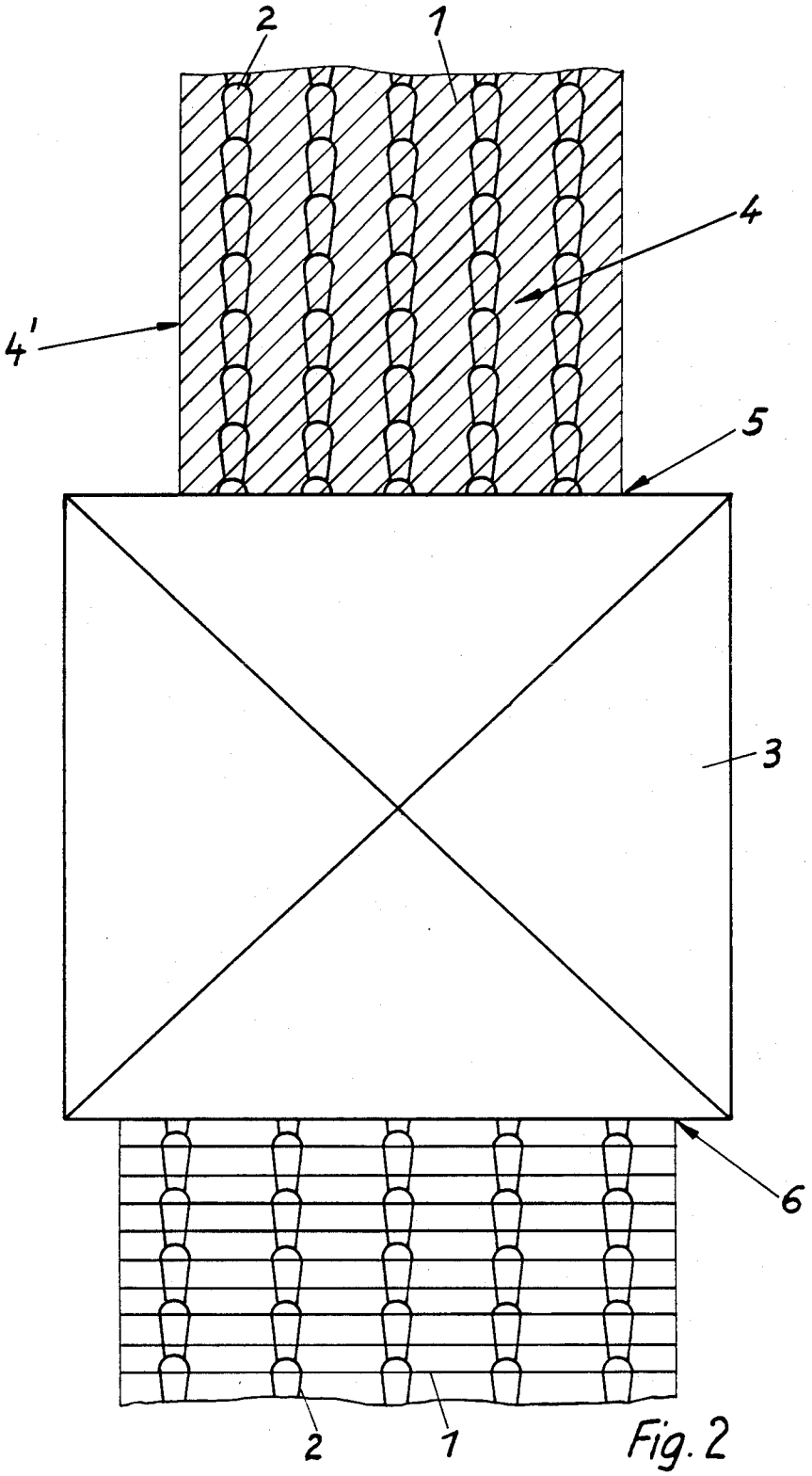
FIG. 2 is a diagram of the passage of a weft and warp knit through a machine in order to change the position of the long weft threads.

The intermediate product is subsequently supplied to a conventional machine 3 in order to change the position of the weft threads in woven fabrics (DE Patent 183 987) which can also be used for the displacement of weft and warp knits (FIG. 2). The structure of a weft and war knit is permanently changed by this machine 3 so that the weft threads or the long weft threads are placed in an oblique position 4 to the perpendicular rows of stitches of the binding system 2. Additionally, when the weft and warp knit is removed from the machine 3, the two thread systems of the weft and warp knit are in the changed position 4, in relation to one another. This is achieved by two chains, grasping the weft and warp knit at the edges, with one chain, because of a special guidance of the same on the way to the working position 5 of the weft and warp knit, eventually remaining behind the other chain. Additionally, the distance between the two chains guided in one area is reduced, since the chain distance at the exit point 5 has to be smaller than at the entrance point 6, because the width of the weft and warp knit decreases with an increasingly oblique positioning of the long weft threads 1.

The result of the passage of the weft and warp knit through the machine 3, according to the patent DE-183 987, is a sheet in which long weft threads 1 are subsequently brought into a markedly oblique angle, and which is narrower than the original width of the supplied weft and warp knit. The long weft threads 1 can, for example, be brought into such an oblique position that they form an angle of 45° or, for example, 60°, as compared to a right-angle long weft thread 1. Every desired angle of the long weft threads 1 can be set. The desired angle 1 of the long weft threads 1 can also be achieved gradually with several passages of the weft and warp knit through the machine 3, in order to change the position of the long weft thread 1. By linking the machine producing the intermediate product with the machine 3 producing the oblique position of the long weft threads 1, there results a synchronized working process.

Figure 10:
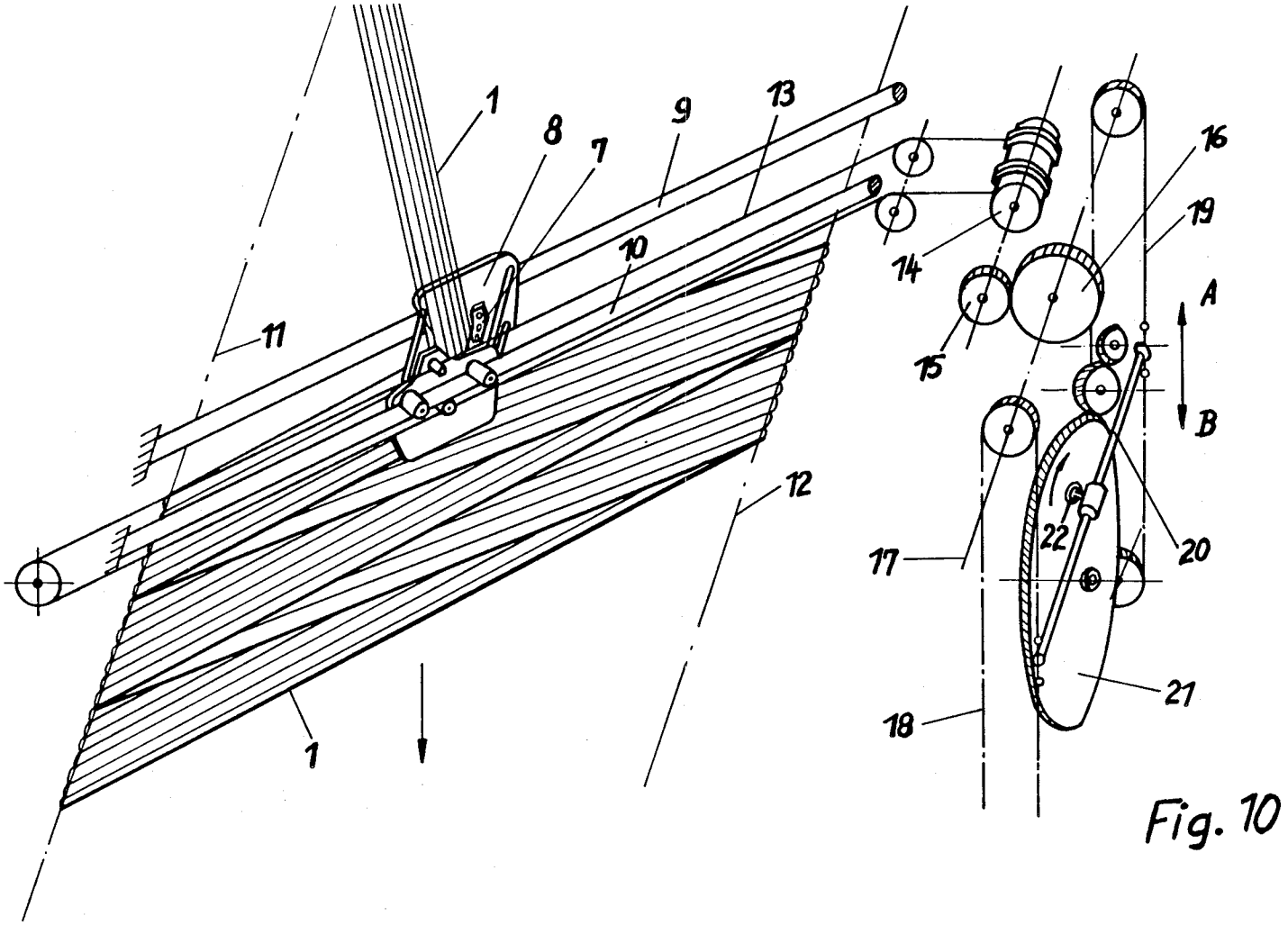
FIG. 10 is a perspective view of a drive arrangement with a weft laying device, which is obliquely movable back and forth to transport chains.

Instead of using the machine 3 for changing the position of the weft threads, an intermediate product can be produced by a special thread knitting machine as well, as illustrated in FIG. 10. The thus produced intermediate product already initially has a very oblique position of the long weft threads 1.

As shown in FIG. 10, a weft laying device 8, having a guide means 7, moves obliquely back and forth between the two transport chains 11;12 provided with hooks. The long weft threads 1, pulled into the weft laying device 8, are thus hung into the hooks of the transport means 11;12 as warp and guided through the working point of the thread knitting machine. The thread knitting process then leads to the production of a sheet, with its long weft threads 1 being fastened to one another by a binding system.

The diagonal or very oblique position of the long weft threads 1 is essentially determined by the setting of the guide rods 9;10 in relationship to the transport chains 11;12. Depending on the respective oblique position of the guide rods 9;10, the oblique angle of the long weft threads 1 is determined. The guide means 7 for the long weft threads 1 in the weft laying device 8 must therefore be designed so that guide means 7 run parallel to the transport chains 11;12, at least at the movement reversing points of the weft laying device 8. The weft laying device 8 preferably has the shape of a rhomboid.

In the FIG. 10 embodiment, the consecutive sections of the long weft threads 1 are arranged not only at an oblique angle but slightly intersecting one another as well. The crossing of the sequential sections of the long weft threads 1 is generally approximately 2° to 5°. If such a crossing is not desired, operation can be in accordance with the prototypes in patent DD 85 409 (corresponding to U.S. Pat. No. 3,655,732) or DD 93 837 (corresponding to U.S. Pat. No. 3,756,043). However, an oblique positioning of the guide rods for the weft laying device is required here as well.

In the thus produced textile goods, the long weft threads run parallel to one another and do not intersect one another in groups. The angle of skew of the long weft threads is identical in all weft threads.

These intermediate products with the originally very oblique position of the long weft threads, according to FIG. 10 of DD 85 409 or DD 93 837, can be used as simple textile goods as well, without doubling the same. Ranges of application include reinforcement interlinings, with the stabilizing effect being necessary in the oblique direction of the long weft threads.

The doubling of the layers of the long weft threads 1 in FIG. 10 can also be done so that several pairs of guide rods 9;10, each having a weft laying device 8, are arranged consecutively. If correspondingly, for example, two pairs of guide rods 9;10 are provided having different directions, the result is a finished textile strip with a long weft thread 1, bound obliquely to the strip length and intersecting one another after the passage of the two prepared layers of the long weft threads 1 through the working point of the thread knitting machine. In addition to the already mentioned two pairs of guide rods 9;10, there is the possibility of mounting a pair of guide rods 9;10 with a weft laying device 8 at a right angle between the transport chains 11;12, in order to work in yet another layer of essentially rectangular long weft threads into the textile strip.

The motive power of the weft laying device 8 is actuated, as shown in FIG. 10, by using a wire 13, the upper strand of which is connected to the weft laying device 8. Both wire ends are fastened to wire drum 14, so that when the wire drum rotates with varied sense of directions, a wire strand rises to wire drum 14 while the other strand returns.

Because of the connection of the weft laying device 8 to the wire 13, the weft laying device 8 moves, as already mentioned above, back and forth between the two transport chains 11;12, which are provided with hooks. The wire drum receives its alternating rotatory movement via the spur gears 15;16 from the shaft 17. The shaft 17 receives the alternating rotatory movement from two continuous roller chains 18;19, between which the eccentric shaft 20 is located. The eccentric shaft 20 is coupled to the continuous roller chains 18;19 at its ends. The eccentric shaft 20, which is eccentrically attached to a spur gear 21 with a relatively large cross section moves, when the spur gear 21 is rotated, back and forth in the directions A, B, with the shaft 17 being displaceable at alternating revolutions. The described drive arrangement thus has the construction and the function of a cross-crank mechanism.

If the back and forth movement of the weft laying device 8 is to be longer or shorter, in order to change the working width of the thread knitting machine, the eccentric pivoting of the crankshaft pin 22 is to be either removed from the turning point of the spur gear 21, or moved closer to it. Even when the oblique position of the guide rods 9;10 is changed, the crankshaft pin 22 at the spur gear 21 has to be changed, in accordance with the path change of the weft laying device 8. In FIG. 11, the weft laying device 81 runs on guide rods 91, 101 diagonally back and forth between the top right 811 and the bottom left 812 of the transporting chains 11 and 12. The weft laying device 82 runs on guide rods 92, 102 diagonally back and forth between the bottom right 821 and the top left 822 of the transporting chains 11 and 12 (though as a result of the perspective way of presentation, it may appear that the filling yarn laying device 82 is moving only back and forth perpendicularly between the transporting chains 11 and 12). The weft laying device 83 operates on guide rods 93, 103 perpendicularly (in the drawing apparently diagonally) between the transporting chains 11, 12.

The driving mechanism (the Scotch yoke transmission mechanism) is the same as in FIG. 10 (the same reference numbers being used in FIG. 11). In addition to the weft laying device 83, the driving mechanism also drives the weft laying devices 81 and 82. For this purpose, the gear wheel pairs 151, 161, the shaft 171 driven by these gear wheel pairs and the wire drums 141, 142 are provided. In the example of the operation shown, the paths covered by the weft laying devices 81 and 82 should be the same, but in each case longer than the path of weft laying device 83, so that the gear wheel pair 151, 161 must "transmit larger" than the gear wheel pair 15, 16 and the diameters of the wire drums 141, 142 should be the same. To provide for the possibility of changing the paths of the weft laying devices 81, 82, 83, the elongated hole 26 is provided, with which the crank throw can be adjusted. The paths can, of course, also be changed by means of other gear wheel pairs 15, 16 or 151, 161.

In FIG. 12, the weft laying devices 84, 85, 86 move back and forth between the transporting chains 11, 12 in much the same way as the weft laying devices 81, 82, 83 of FIG. 11. The same driving mechanism, which drives all three weft laying devices 84, 85, 86, is also shown. FIG. 12 differs from FIG. 11 in that the weft laying devices 84, 85, 86 are each equipped with guiding means 74, 75, 76 for the weft yarns 1, which can be shifted transversely to the back and forth motion of the weft laying devices 84, 85, 86 according to the example of U.S. Pat. No. 3,665,732, in order to be able to lay weft sections which are simultaneously disposed diagonally and in parallel. For the purpose of controlling the guiding means 74, 75, 76, each of the guiding means 74, 75, 76 is connected with a rod 27, 28, 29, so as to be movable longitudinally. The guiding means 74, 75, 76 are positioned in accordance with the displacements of the rods 27, 28, 29. FIGS. 1, 2, 3 and 4 of U.S. Pat. No. 3,665,732 disclose suitable well-known driving mechanisms for the rods 27, 28, 29.

In FIGS. 11 and 12, the transporting chains 11, 12 move in the direction of the arrows A. The broken line B indicates a row of needles for connecting the weft yarns with warp-knit stitches.

Figure 3:
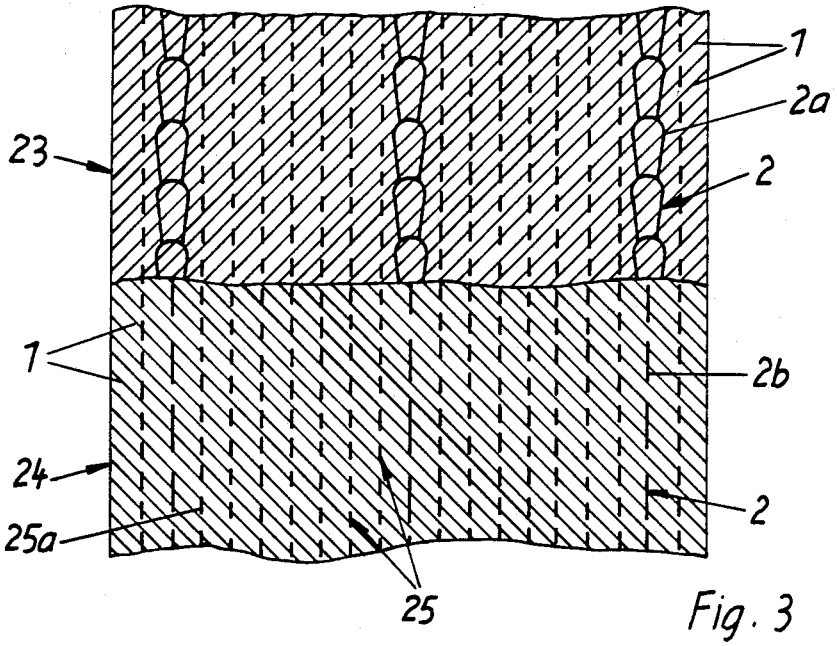
FIG. 3 is a schematic depiction of a section of a textile strip seen from one side, with both main layers of the textile strip being laid together, with the sides carrying the connection stitches of the basic binding, and with the connection stitches of the top binding being visible, as well as the stitch loops of the one basic binding on the top layer and the connection stitches of the other basic binding on the bottom layer.
Figure 4:
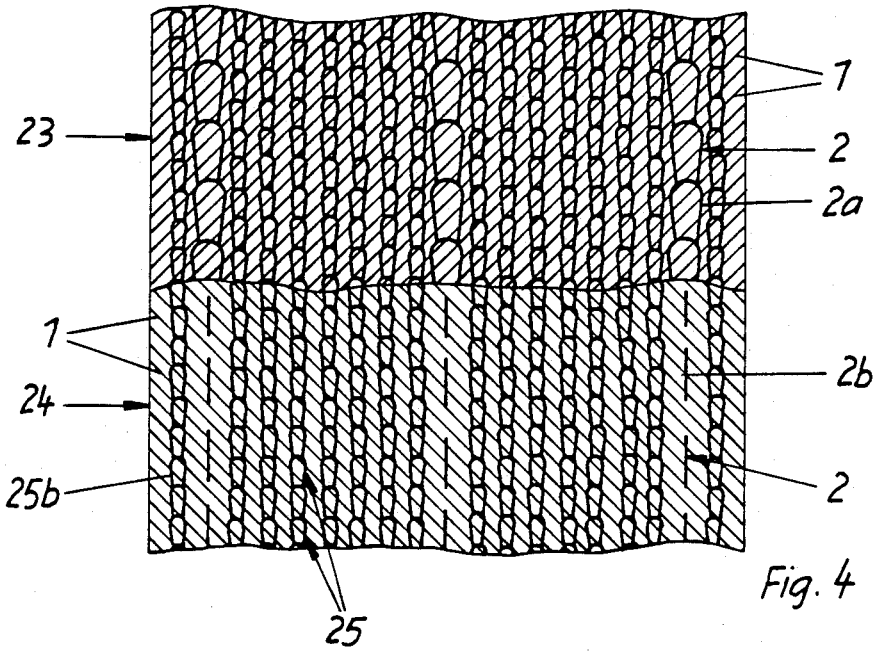
FIG. 4 is similar to FIG. 3, however, with the side of the textile strip being taken as a front view, showing the stitch loops of the top binding, as well as the stitch loops of the one basic binding on the top layer, and the connection stitches of the other basic binding on the bottom layer.

According to FIG. 3, which shows a section of the textile strip, two unequally long pieces of the main layers 23;24 of the textile strip are sewn or stitched together. The one main layer 23 is the top layer 23 and the other main layer 24 the bottom layer 24. This generally applies for FIGS. 4 to 9 as well. Each main layer 23;24 consists of a weft and warp knit with diagonal long weft threads 1 and a binding system 2, representing the basic binding 2 for the textile strip. One speaks of main layers 23;24, because a weft and warp knit can itself have several layers and a thread knitted material can, for example, be quasi two-layered. In the case of FIG. 3, both main layers 23;24, i.e., the top layer 23 and the bottom layer 24, have the same basic binding 2—a fringe binding—having stitch loops 2*a* on the one side of the textile strip and connection stitches 2*b* on the other side. For the purpose of producing textile goods which contain long weft threads and run diagonally to the strip length and essentially intersect one another diagonally, two main layers 23;24 were doubled by connecting them to one another, so that the angle of crossing of the long weft threads 1 of the main layers 23;24, located either above or below the horizontal line, is, for example, 120°. The doubling of the main layers 23;24 can be accomplished either by folding a strip of the weft and warp knit longitudinally, or by placing two separate strips next to one another.

Having described the production of the weft and warp knit having very oblique long weft threads 1, the following process steps have been described: 1. doubling of the strip of the weft and warp knit and 2. connection of the two components of the doubled strip.

The connection system of the main layers 23;24 will be referred to as top binding. The top binding 25 comprises connection stitches 25*a* and stitch loops 25*b*

In order to clarify FIG. 3, the top binding 25 has been merely provided between the perpendicular rows of the stitch loops 2*a* of the basic binding 2. In reality, there is a top binding 25 in the area of the basic binding 2 as well. The top binding 25 is a fringe binding. It is self-understood that other bindings can be used in lieu of the fringe binding. The stitch loops 2*a* of the basic binding 2 can be shorter or longer or equal to the stitch loops 25*b* of the top binding 25.

It is preferable that the stitch loops 2*a* in the basic binding 2 be relatively long, when the position of the long weft threads 1 is changed into an oblique position, after having produced the weft and warp knit, since the changed setting of the long weft threads 1 is then easier to achieve. The stitch loop 2*a* of the basic binding do not necessarily have to have the same length.

Figure 5:
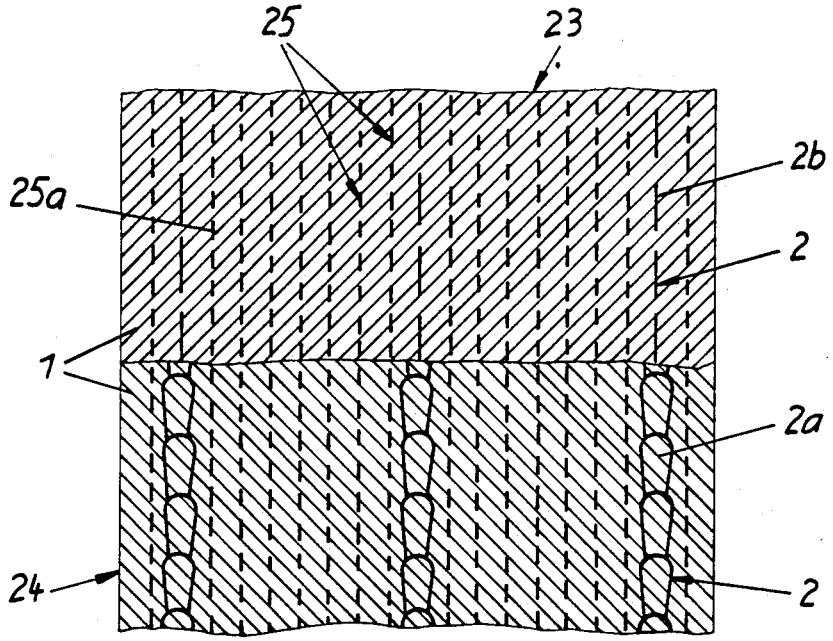
FIG. 5 is a schematic depiction of a section of a textile strip, taken from one side, with the two main layers of the textile strips with the sides having the stitch loops and the basic binding placed together, and with the connection stitches of the top binding, and the connection stitches of the one basic binding on the top layer, and the stitch loops of the other basic binding provided on the bottom layer.
Figure 6:
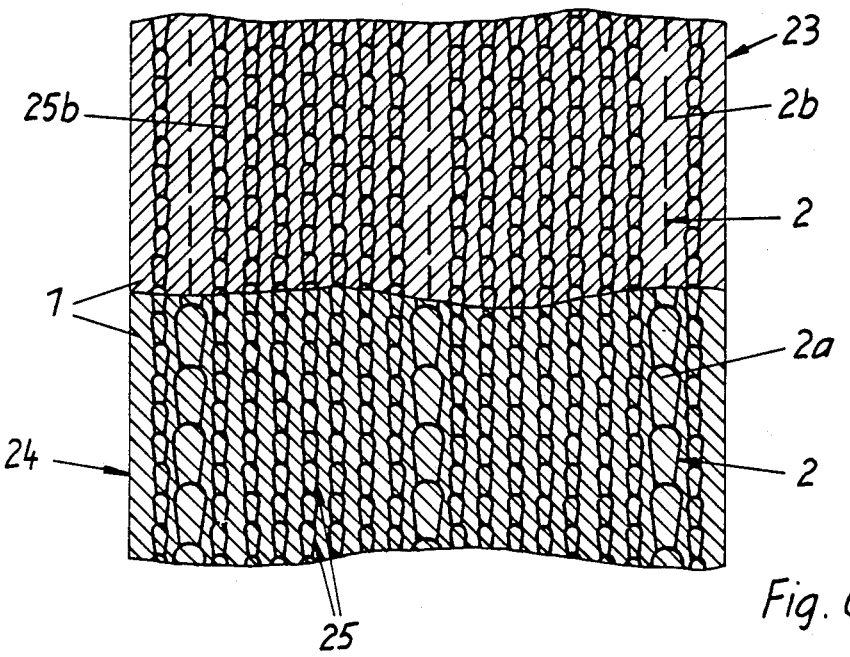
FIG. 6 is similar to FIG. 5, however, seen from one side of the textile strip, on which the stitch loops of the top binding can be seen, as well as the connection stitches of the basic binding on the top layer, and the stitch loops of the other basic binding on the bottom layer.

The section of the textile strip illustrated in FIG. 3 is furthermore characterized in that the main layers 23;24 are placed next to one another with the sides carrying the connection stitches 2*b* of the basic binding 2. This applies to the illustration in FIG. 4 as well. In contrast to FIG. 3, the side of the stitch loops 25*b* of the top binding 25 was chosen as the front view. If one combines the main layers 23;24 with their sides carrying the stitch loops 2*a* of the basic binding 2, the result is patterns, as shown in FIGS. 5 and 6. In these doubled variations, the connection stitches 2*b* of the basic binding 2 are located on the top layers (main layers). All other characteristics of these patterns are analogous to FIGS. 3 and 4.

Figure 7:
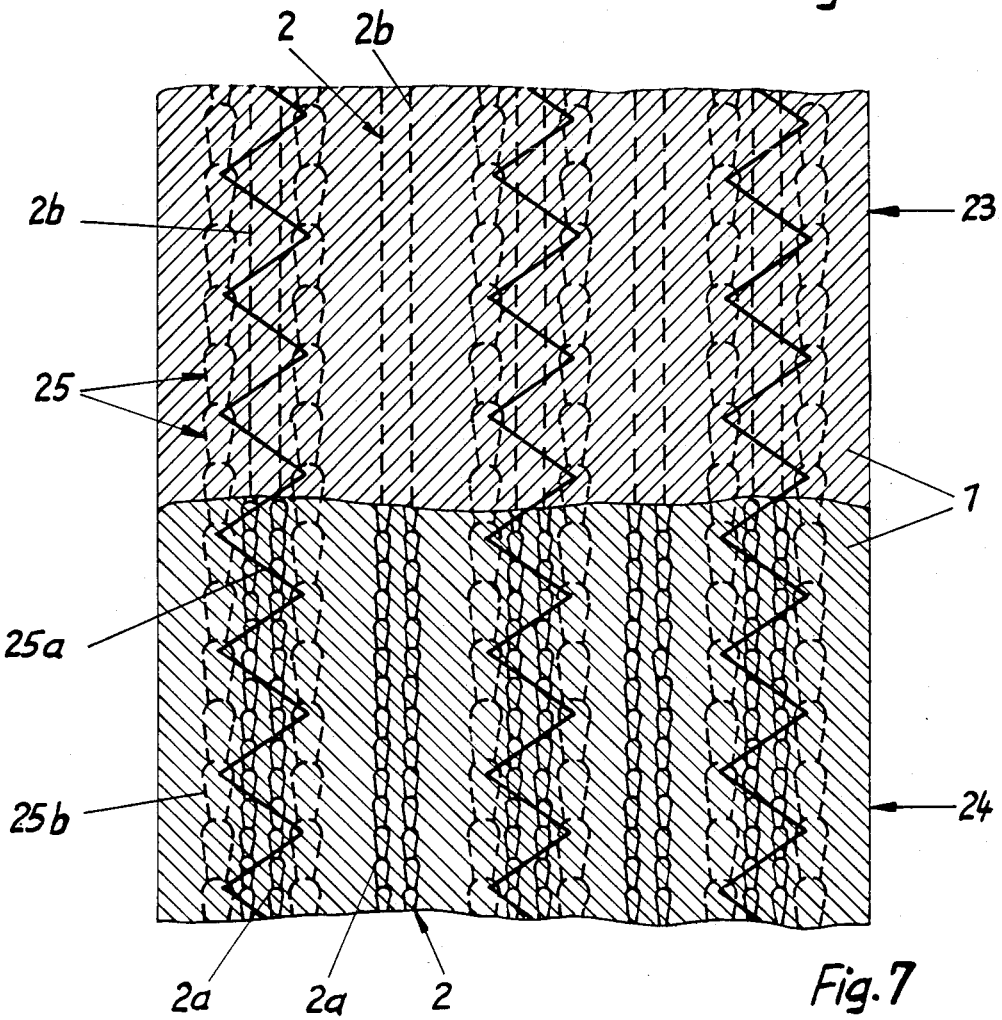
FIG. 7 is similar to FIG. 5, but with the top connection being a tricot connection with diagonal connection stitches, and with the basic binding of the two main layers of the textile strip consisting of smaller stitches than the top binding.

The pattern in FIG. 7 essentially corresponds to the pattern in FIG. 5, since the top layer 23 and the bottom layer 24 were laid next to one another, with the sides carrying the stitch loops 2*a* of the basic binding 2, and the front view shows the connection parts 25*a* of the top binding 25. The stitch loops 2*a* and the connection stitches 2*b* of the basic binding 2 are smaller than the stitch loops 25*b* and the connection stitches 25*a* of the top binding 25. Furthermore, a tricot binding is used instead of a fringe binding (FIGS. 3 to 6), in order to connect the top layer 23 and the bottom layer 24, or the two main layers 23;24. The stitch loops 25*b* are arranged on the bottom side of the illustrated pattern, and have been depicted by a dotted line.

Figure 8:
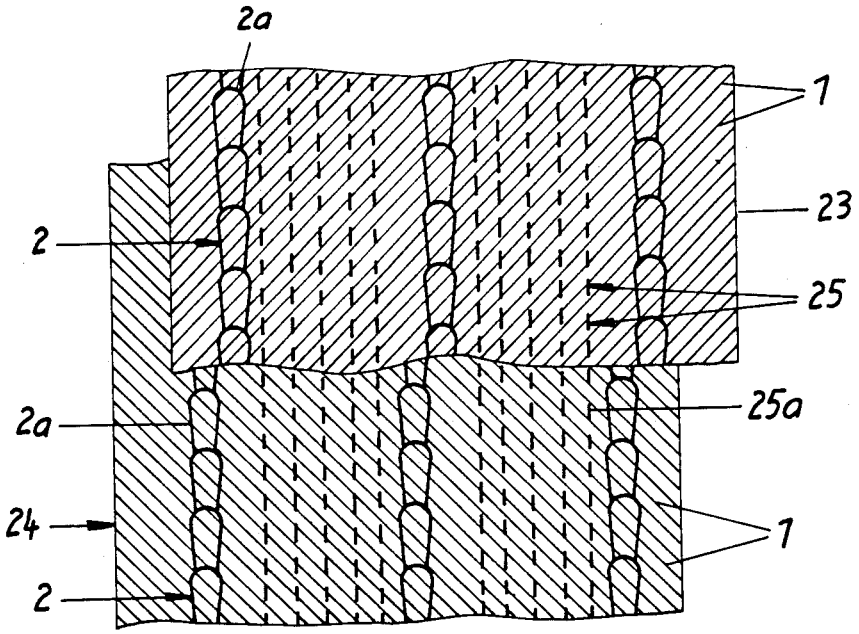
FIG. 8 is an additional schematic depiction of a section of a textile strip, in which the main layers are arranged with respect to one another in a staggered fashion, and placed adjacent to one another, so that the connection stitches of the basic binding of the main layer and the stitch loops of the basic binding of the other main layer touch.
Figure 9:
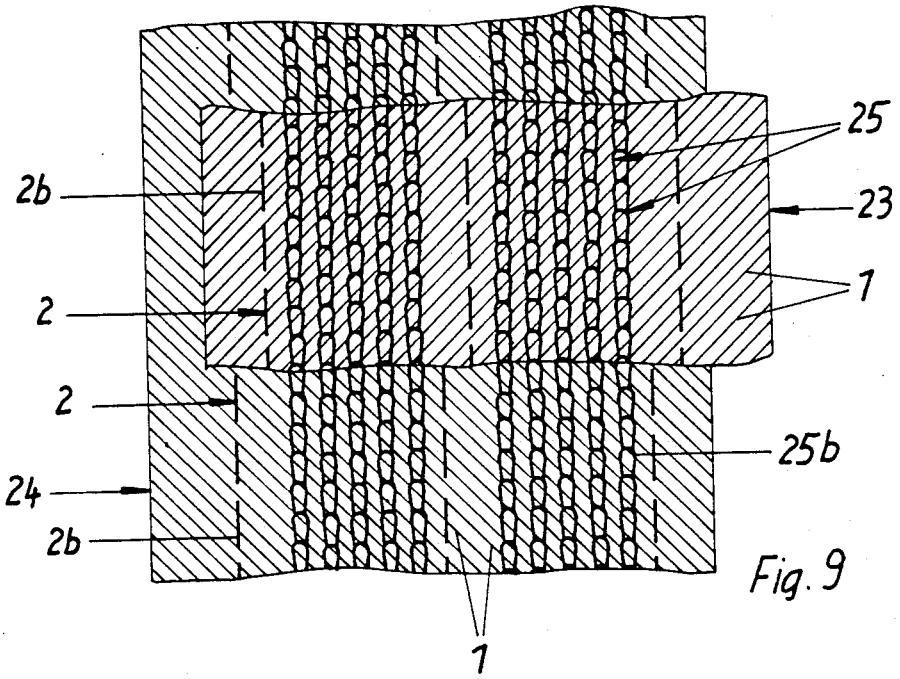
FIG. 9 is similar to FIG. 8, however, not viewing a side of the textile strip, which shows the connection stitches of the top binding, but instead showing a side of the textile strip, which is provided with the stitch loops of the top binding.

FIGS. 8 and 9 illustrate how the textile strip is designed structurally when the stitch loops 2*a* of one the main layers 23;24 touch the connection stitches 2*b* of the other of main layers 23;24, following the doubling of the weft and warp knits. Additionally, it can be noted that the main layers 23;24 are adjacent to one another in a displaced fashion, which is very common.

Furthermore, the textile strip can be produced from more than two main layers 23;24. It is possible to produce interlinings like sheets or warps, on or between the main layers 23;24.

The pattern variations shown in FIGS. 3 to 9 merely represent examples. Especially when changing the direction of the long weft threads 1 and the thickness, a number of additional patterns can be produced as well.

It thus will be seen that there is provided a method and apparatus for the production of a textile strip, and the textile strip per se as a new article of manufacture, which attain the various objects of the invention, and which are well adapted for the conditions of practical use. As numerous alternatives and equivalents within the scope of the present invention will occur to those skilled in the art, besides those alternatives, equivalents, variations and modifications mentioned supra, it will be understood that the invention extends fully to all such equivalents, alternatives or the like, and is to be limited only by the scope of the recitations in the appended claims, and functional and structural equivalents thereof.

We claim:

1. A warp knitting machine, and especially a sewing-knitting machine,for producing a warp-knit fabric having endless oblique and diagonal filling threads, comprising a pair of spaced-apart parallel chain conveyors for transporting a plurality of filling-thread sections to a stitch-forming site of the machine;

a plurality of hooks carried on each chain conveyor for holding a plurality of filling thread sections between said chain conveyors, each filling thread section being defined by a section of filling thread extending from a hook holding the filling thread section on one of said chain conveyors to a hook holding the filling thread section on the other of said chain conveyors;

means for laying filling thread sections in said hooks between said chain conveyors, said means for laying comprising a first filling laying device for laying filling thread sections, said first filling laying device being movable back and forth between said chain conveyors obliquely and diagonally with respect to the direction of transportation of said chain conveyors for inserting the endless filling threads forming the filling thread sections onto the hooks of said chain conveyors at an oblique and diagonal angle to the direction of transportation of said chain conveyors, said first filling laying device including means for guiding the endless filling threads from said first filling laying device onto said hooks;

means for controlling movement of said filling thread laying means relative to movement of said chain conveyors so that each respective hook holding a respective filling thread section on one of the chain conveyors is longitudinally displaced with respect to the chain conveyors from the hook on the other chain conveyor also holding that filling thread section; and means for combining the endless filling threads of filling thread sections inserted on the hooks of said chain conveyors by warp-knitted stitches, thereby to produce said fabric having endless oblique and diagonal filling threads.

2. A warp knitting machine as in claim 1, wherein said means for laying further comprises a second filling laying device arranged consecutively with respect to said first filling laying device along the direction of transportation of said chain conveyors for laying filling thread sections, said second filling laying device being movable back and forth between said chain conveyors for inserting endless filling threads onto the hooks of said chain conveyors, said second filling laying device including means for guiding the endless filling threads from said second filling laying device onto said hooks.

3. A warp knitting machine as in claim 2, wherein said first and second filling laying devices move back and forth between said chain conveyors along two mutually different paths of motion with respect to the direction of transportation of said chain conveyors.

4. A warp knitting machine as in claim 3, wherein said second filling laying device moves back and forth between said chain conveyors obliquely and diagonally with respect to the direction of transportation of said chain conveyors for inserting said endless filling threads onto said hooks at an oblique and diagonal angle to the direction of transportation of said chain conveyors.

5. A warp knitting machine as in claim 3, wherein said second filling laying device moves back and forth between said chain conveyors obliquely and diagonally with respect to the direction of transportation of said chain conveyors in a mutually opposite direction to said first filling laying device with respect to said chain conveyors.

6. A warp knitting machine as in claim 1, wherein said guiding means is provided parallel to said chain conveyors at least at a point where said first filling laying device changes its back and forth movement.

7. A warp knitting machine as in claim 2, wherein each guiding means of said first and second filling laying device is provided parallel to said chain conveyors at least at a point where its respective filling laying device changes its back and forth motion.

8. A warp knitting machine as in claim 1, further comprising means for adjusting the oblique and diagonal angle of said first filling laying device with respect to the direction of transportation of said chain conveyors.

9. A warp knitting machine as in claim 2, further comprising means for adjusting the oblique and diagonal angle of at least one of said filling laying devices with respect to the direction of transportation of said chain conveyors.

10. A warp knitting machine as in claim 1, further comprising a pair of parallel guide rods mounted obliquely and diagonally between said chain conveyors with respect to the direction of transportation of said chain conveyors for slidably supporting the back and forth movement of said first filling laying device.

11. A warp knitting machine as in claim 1, wherein said first filling laying device is constructed as a rhomboid.

12. A warp knitting machine as in claim 1, further comprising a cable means connected to said first filling laying device and a drum connected to said cable for winding said cable therearound, whereby alternating rotational motion of the drum moves the first filling laying device back and forth between said conveyors by means of said cable.

13. A warp knitting machine as in claim 1, further comprising a driving mechanism for driving the first filling laying device, said driving mechanism including a spur-toothed wheel and an adjustable crank pin disposed on said spur-toothed wheel for adjusting a length of the back and forth movement of said first filling laying device between said chain conveyors.

14. A method for producing a warp-knit fabric, and especially a sewn-knitted fabric, having oblique and diagonal filling threads, comprising:

guiding at least a first group of endless filling threads in a first direction between a pair of chain conveyors obliquely and diagonally with respect to a direction of travel of said chain conveyors and onto a first set of hooks provided on one of the pair of chain conveyors;

guiding at least said first group of endless filling threads in a second direction between said pair of conveyors opposite said first direction and obliquely and diagonally with respect to the direction of travel of said chain conveyors and onto a second set of hooks provided on another of the pair of chain conveyors;

conveying at least the first group of endless filling threads on said hooks to a stitch forming site of a warp-knitting or sewing-knitting machine; and combining at least the first group of endless filling threads with warp-knitted stitches, wherein said guiding is always effected by filling thread laying means which are oriented and move only obliquely and diagonally with respect to the direction of travel of said chain conveyors.

15. A method as in claim 14, wherein at least the first group of endless filling threads are guided in a row, said row running parallel to said chain conveyors at least when said row is adjacent a chain conveyor.

16. A method as in claim 14, wherein at least two groups of endless filling threads are guided obliquely and diagonally with respect to the direction of travel of said chain conveyors onto said second set of hooks, and at least the two groups of endless filling threads overlapping each other.

17. A method as in claim 14, wherein a plurality of first groups of endless filling threads are guided obliquely and diagonally with respect to the direction of travel of said chain conveyors onto said first and second sets of hooks to form a first filling thread layer, and a plurality of second groups of endless filling threads are guided obliquely and diagonally with respect to the direction of travel of said chain conveyors onto said first and second sets of hooks to form a second filling thread layer, the endless filling threads of said second filling thread layer crossing the endless filling threads of said first filling thread layer.

18. A method as in claim 14, wherein a plurality of first groups of endless filling threads are guided obliquely and diagonally with respect to the direction of travel of said chain conveyors onto said first and second sets of hooks to form a first filling thread layer having filling threads mutually crossing each other in zigzag fashion, and a plurality of second groups of endless filling threads are guided obliquely and diagonally with respect to the direction of travel of said chain conveyors onto said first and second sets of hooks to form a second filling thread layer having filling threads parallel to each other, the filling threads of the first and second filling thread layers mutually crossing each other.

19. A method as in claim 14, further comprising combining said stitched at least first group of endless filling threads with a prefabricated flat textile product.

20. A method as in claim 17, further comprising combining the first and second filling thread layers with a prefabricated flat textile product.

* * * * *